United States Patent [19]

Burnett et al.

[11] 4,391,285

[45] Jul. 5, 1983

[54] SMOKING ARTICLE

[75] Inventors: George H. Burnett, Richmond; Warren E. Claflin, Bon Air; Harry V. Lanzillotti, Midlothian; A. Clifton Lilly, Jr., Richmond; John F. Nienow, Midlothian; Thomas S. Osdene; Alline R. Wayte, both of Richmond, all of Va.

[73] Assignee: Philip Morris, Incorporated, New York, N.Y.

[21] Appl. No.: 148,124

[22] Filed: May 9, 1980

[51] Int. Cl.[3] ..... A24B 3/14; A24F 1/00; A24F 5/00

[52] U.S. Cl. ..... 131/364; 131/360; 131/77; 131/78; 131/79; 131/366; 131/367; 131/368; 131/372; 131/375; 131/370; 131/85

[58] Field of Search ..... 131/2, 8, 7, 9 R, 10, 131/10 A, 10.3, 10.5, 10.7, 10.9, 17 A–17 AE, 140 C, 20 R, 20 A, 15 C, 280, 77, 78, 79, 85, 216, 226, 336, 339, 340, 348, 352, 353, 354–357, 360, 364, 366, 367, 369–375

[56] References Cited

U.S. PATENT DOCUMENTS

| | | | |
|---|---|---|---|
| 235,885 | 12/1880 | Lindsley | 131/20 R |
| 235,886 | 12/1880 | Lindsley | 131/20 R |
| 346,025 | 7/1886 | Cook | 131/9 |
| 1,437,956 | 12/1922 | Blair | 131/9 |
| 1,559,322 | 10/1925 | Hohn | 131/20 R |
| 1,778,482 | 10/1930 | Barns | 131/9 |
| 2,349,551 | 5/1944 | Helm | 131/9 |
| 2,485,670 | 10/1949 | Sawa et al. | 131/140 C |
| 2,598,680 | 4/1950 | Frakenburg | 131/140 C |
| 3,085,580 | 4/1963 | Muth | 131/140 C |
| 3,096,772 | 7/1963 | Korber | 131/20 R |
| 3,098,492 | 7/1963 | Wurzburg et al. | 131/140 C |
| 3,203,432 | 8/1965 | Green et al. | 131/140 C |
| 3,209,763 | 10/1965 | Parmele et al. | 131/140 C |
| 3,223,090 | 12/1965 | Strubel et al. | 131/140 C |
| 3,260,265 | 7/1966 | Oster | 131/20 R |
| 3,349,776 | 6/1967 | Bell et al. | 131/9 |
| 3,364,935 | 1/1968 | Moshy et al. | 131/140 C |
| 3,373,751 | 3/1968 | Wallberg | 131/140 C |
| 3,404,691 | 10/1968 | Moshy et al. | 131/140 C |
| 3,410,279 | 11/1968 | Moshy et al. | 131/140 C |
| 3,516,417 | 6/1970 | Moses | 131/9 |
| 3,528,434 | 9/1970 | Halter et al. | 131/140 C |
| 3,529,602 | 9/1970 | Hind et al. | 131/140 C |
| 3,738,374 | 6/1973 | Bennet | 131/2 |
| 3,756,249 | 9/1973 | Selke et al. | 131/9 |
| 3,774,622 | 11/1973 | Steegerwald | 131/9 |
| 3,840,028 | 10/1974 | Yatrides | 131/253 |
| 3,863,644 | 2/1975 | Hunt | 131/9 |
| 3,905,377 | 9/1975 | Yatrides | 131/9 |
| 3,932,081 | 6/1976 | Buchmann | 131/140 C |
| 4,027,679 | 6/1977 | Kaswan | 131/9 |
| 4,120,309 | 10/1978 | Brantl et al. | 131/170 R |
| 4,142,534 | 3/1979 | Brantle | 131/8 R |
| 4,340,072 | 7/1982 | Bolt et al. | 131/273 |

FOREIGN PATENT DOCUMENTS

| | | | |
|---|---|---|---|
| 1167717 | 4/1964 | Fed. Rep. of Germany | 131/140 C |

*Primary Examiner*—V. Millin

[57] ABSTRACT

Smoking articles comprising a high density, relatively low porosity coherent mass of combustible tobacco-containing material having at least one passage extending therethrough are disclosed. In a preferred embodiment the smoking article is a cylinder having at least one passage axially therethrough. The smoking article may further comprise a plug of ignitable material in passage blocking position at one end of the passage, said plug being such as to permit puff induced air flow therethrough. At least one additional plug may be similarly disposed at the opposite end of the passage or at an intermediate point in the passage. By adjusting the density, the surface area and/or the porosity of the mass available for combustion, the per puff delivery of tar by the smoking article upon combustion may be controlled.

27 Claims, 6 Drawing Figures

SMOKING ARTICLE

BACKGROUND OF THE INVENTION

The present invention relates to tobacco-containing smoking articles, the physical properties of which may be adjusted, thereby modifying their combustion properties so as to permit control of tar delivery by the article during combustion.

The quantity of combustion products produced by a burning bed of combustible material, such as tobacco or non-tobacco smoking materials, is primarily dependent on certain physical properties of the burning materials. These physical properties which influence the quantity of combustion products include the surface area of material available for combustion, the density and porosity of the material, the volume of air available for combustion, the velocity at which air is made available for combustion, the temperature at which the material combusts and the composition of the combustible material.

A primary cause of tar production during combustion in a conventional smoking article, such as a cigarette, cigar or pipe, is pyrolysis. Pyrolysis may be defined as the thermal evolution of tars and gases by heat produced from the combustion of a carbonaceous incandescent coal. As pyrolysis reduces smoking material to its carbonaceous skeleton, the carbonaceous remains, in turn, combust and provide heat for further pyrolysis of fresh material located adjacent to the combusting material.

Smoking materials used in conventional smoking articles are generally in the form of shredded tobacco leaf, shredded reconstituted tobacco sheet, tobacco stems and combinations thereof and, as such, present a relatively large surface area for pyrolysis. In such a conventional smoking article, gases drawn by a puff through the incandescent coal are heated. The heated gases pass through noncombusted tobacco adjacent to the coal and pyrolysis occurs. Thus, in conventional products pyrolysis occurs not only due to the heat of conduction and radiation from the coal, but also due to the heat transferred by such heated gases.

The present invention provides tobacco-containing smoking articles wherein control of combustion and pyrolysis processes is effected by adjusting properties, such as porosity, surface area and density of the tobacco-containing mass. By thus controlling the pyrolysis and combustion processes, gas phase and tar delivery by the articles of the present invention is concomitantly controlled.

SUMMARY OF THE INVENTION

This invention provides tobacco-containing smoking articles wherein tar delivery during combustion is controlled by adjusting the density, porosity, surface area and/or composition of the article. The smoking articles comprise a coherent mass of combustible tobacco-containing material, said mass having at least one through passage extending from a first opening in the surface of said mass to a second opening remote from the first, said mass of tobacco-containing material being of a density and porosity such as to substantially occlude gas flow therethrough, while further being of a porosity sufficient to support combustion of said mass when ignited.

The articles may be formed by extrusion of a homogeneous mixture of tobacco material and water containing a volatile organic liquid which is compatible with the tobacco, said mixture having a solids content of 55 to 75 weight percent, and drying the resulting extrudate. Nontobacco combustible filler particles, as well as burn additives and/or flavorants, may be included in the tobacco mass.

In a preferred embodiment, the smoking article of the invention has a passage extending axially through a mass of cylindrical shape, the cross-sectional area of said passage most preferably being larger than that of the mass. It is also preferred to have an easily ignitable air permeable plug disposed in passage blocking position in at least one end of the passage; said plug may optionally contain flavorants which are thermally released.

DETAILED DESCRIPTION OF THE INVENTION

Figure 1:
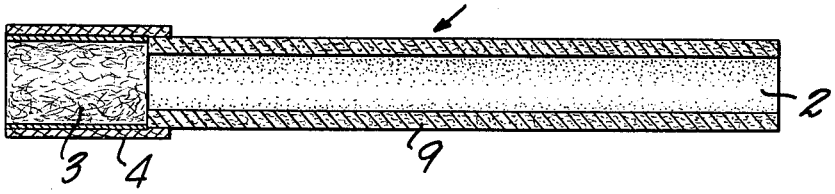
FIG. 1 depicts in section a smoking article made in accordance with the present invention and having a through passage extending therein and having a conventional filter plug attached thereto by means of tipping paper.
Figure 1A:
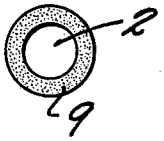
FIG. 1*a* is an end view of the smoking article of FIG. 1.

In accordance with the present invention, tobacco-containing smoking articles formed from a coherent mass having at least one passage therethrough are provided. Delivery of tar and gas phase constituents during combustion by the smoking articles of the invention is controlled by adjusting the density, surface area and porosity of the combusting portion of the mass. By decreasing the surface area and porosity of the mass available for combustion, while increasing its density, it is possible to minimize the tar delivery by the smoking articles of the invention.

Specifically the smoking articles of the present invention can be produced from a coherent mass of combustible tobacco-containing material wherein the surface area of the mass available for the production of tar may be considerably lower than that of a conventional smoking product in current usage. Moreover, the density of the mass in the instant smoking article may be significantly greater than that generally observed in conventional smoking products, while the porosity of the mass is substantially less. The resulting smoking article has substantially reduced tar and gas phase delivery relative to conventional smoking products.

By reducing porosity and surface area and increasing density of the material being burned, the smoking articles of the invention produce a reduced quantity of pyrolysis products per puff. Since the density, porosity and geometry of the smoking articles of the invention control the volume of air and the velocity at which it is drawn over and through a burning coal during a puff and inhibit access of heated gases to unburned tobacco material, control of the pyrolysis and combustion processes in the present smoking articles is possible. Concomitantly, the temperature of the air passing through the passage of smoking articles of the invention can be maintained at a high enough level to effect thermal release of flavorants downstream of the burning coal thereby providing means for low tar, fully flavored smoke delivery. The present smoking articles are thus advantageous in that shape, density and porosity of the mass will lower tar delivery naturally without the addition of chemicals that alter combustion and in certain instances adversely affect the subjective qualities of the tobacco, while permitting distillation of flavorants.

In the practice of the invention, a combustible tobacco-containing material is formed into a coherent mass having at least one passage extending from a first opening in the surface of the mass to a second opening remote from the first. Both the density and porosity of the formed mass are such that puff induced air flow through the smoking article is preferentially through the passage; that is, the density and porosity of the mass are such that gas flow through the mass is substantially occluded. Porosity, however, must be high enough to support combustion and preferably sufficient to support static, nonpuff aided, combustion.

In the preferred embodiment of the invention, the mass is formed into a cylinder having at least one passage axially therethrough. This passage permits the dense smoking material to be puffed, aids in the control of volume and velocity of air which passes through the coal, reduces the coal volume and serves as an air passageway whereby the smoke generated during combustion is diluted by air when drawn upon by the smoker. This obviates the necessity of highly diluted, ventilated filters frequently employed in conventional low delivery smoking articles.

The tobacco-containing material employed to form the coherent mass may comprise high quality, highly flavored tobacco, such as bright, burley, Oriental or mixtures thereof, preferably in comminuted form. Other tobacco materials, such as reconstituted tobaccos and prepyrolyzed tobaccos may also comprise all or part of the tobacco-containing material.

Generally the tobacco to be comminuted will have a moisture content in the range of about 5 to 15% OV, and preferably 10% OV. As used herein, the term OV (oven volatiles) represents the moisture content of tobacco determined as percent oven volatiles. OV is determined by placing a weighed sample of tobacco in an air-circulating oven and maintaining the sample in the oven at a temperature of 100° C. for a period of 3 hours after which the sample is again weighed. The difference in the two weight values expressed as a percentage of the original weight is defined as OV.

Conventional means, such as a ball mill, a plate or disc-type colloidal mill or blendor, may be used to reduce the starting tobacco to the desired particle size. The time required to accomplish this will, of course, depend on the original size of tobacco components to be comminuted and to some extent on the type of tobacco used as well as the moisture content thereof.

In a preferred practice, the mass of the smoking article is formed by extrusion. In such cases a homogeneous mixture of the comminuted tobacco materials and water is formed. For purposes of extrusion, the tobacco particles are preferably below about 30 mesh and are present in an amount sufficient to produce a mixture having a solids content in the range of about 55 to 75 weight percent solids, and preferably 60–70% solids. No binders are required to effect formation of a coherent extrudate.

Mixing of the comminuted tobacco with any additional ingredients may be effected with any suitable mixer. For example, conventional Hobart mixers equipped with a flat paddle or beater-type blade, ribbon-type mixers and the like or any other mixer that will effect an even distribution of liquid to tobacco is suitable.

The aqueous tobacco mixture employed in extrusion preferably additionally contains a volatile organic liquid which is compatible with the tobacco. Such a liquid serves to improve the density and porosity characteristics of the final smoking article, possibly due to rapid vaporization during drying following extrusion.

The organic liquids which may be employed are preferably those having a higher vapor pressure than water and include only those liquids which are compatible with tobacco products. For purposes of this application, liquids are compatible with tobacco if they do not appreciably react with tobacco constituents and in addition mix sufficiently with the tobacco material so as to avoid separtion during the article forming operation. Further, it is preferable to employ liquids, which when mixed with tobacco products, do not adversely affect the aromatic or subjective qualities thereof on smoking. Preferred liquids include those which may easily be removed by evaporation under relatively nondrastic heating or drying conditions and which upon evaporation leave no appreciable residue. Among the suitable organic liquids are straight or branched-chain hydrocarbons of about 5 to 8 carbon atoms, such as the pentanes, hexanes and heptanes. Straight or branched-chain alcohols selected from 1 to 8 carbon atoms and including methanol, ethanol, propanol, isopropanol, butanol and the like are also suitable for use. Moreover, the "Freon" liquids including trichloromonofluoromethane and dichlorodifluoromethane may be used. Selected ketones, e.g., methyl ethyl ketone, ethers, halohydrocarbons and the like, may be used in some instances. The selected liquid may be used alone or, in some instances, a combination of two or more agents may be used depending on the type of smoking article being produced.

The ratio of total water in the mixture to volatile organic liquid will depend to some extent on the type and mesh of tobacco and the specific liquid being used but generally will be in the range of about 6 parts water to 1 part organic liquid to about a 1:1 ratio of each. Where less than −60 mesh tobacco is employed, a ratio of about 2 parts water to 1 part organic liquid is preferred.

The addition of liquid ingredients to tobacco particles may be simultaneous or the water may be added first followed by addition of the volatile agent. Mixing is generally accomplished at room temperature and is generally effected in a closed container to prevent premature volatilization of the organic liquid. The time necessary to achieve even distribution of the liquid and tobacco particles depends to a great extent on particle size as well as the type of liquid combination used. Generally 15 minutes to several hours is sufficient to obtain the desired distribution of liquid.

It may also be desirable to add filler materials to the aqueous tobacco mixture. Filler materials are meant to include calcium carbonate, selected carbon materials, diatomaceous earth, attapulgite and the like. Up to about 40–50% of the solids in the mixture may comprise such fillers without requiring addition of binders. If desired, burn additives may also be added to the mixture to adjust burn properties.

When all the desired ingredients have been added, and an homogeneous mixture is obtained, the thus prepared material is ready for forming into the desired smoking articles. Processes such as molding and extrusion are suitable for this purpose. Following formation the articles are dried either by simple evaporation at room temperature or by heating. Rapid drying of the extruded product may enhance the static burn properties of the smoking article. Such rapid drying may be effected directly on the extruded product or following rewetting of a dried extruded product.

As previously indicated extrusion is a preferred means for forming the smoking articles of the invention. Conventional ram or screw extruders may be employed to produce smoking articles having shape, density and porosity according to the requirements of the present invention. Specifically thin-walled tobacco tubes which are of high density and low porosity and which burn with coal temperatures in the range of 585° to 785° C. may be produced by extrusion.

The extrusion process causes natural binding agents contained within the tobacco matrix to be released, resulting in a cohesive extruded article suitable for smoking, without the need for additional binders. A suitable extruder is a Wayne plastics extruder equipped with a screw adapted to rotate at 1 to 120 rpms. Generally it is preferably to cool the extrusion unit during operation to prevent heat build-up within the barrel thereof. The pressure build-up in the extruder will vary to a great extent during extrusion depending on the composition of the materials being extruded. Usually pressures up to 2500 psig are employed with screw extruders and preferably a pressure less than 1200 psig is employed. When hollow tobacco tubes are extruded it may be desirable to introduce air flow into the inner part of the tube to prevent collapse thereof.

In the preferred embodiment, the smoking article is in the form of a hollow cylinder. Most preferably the wall thickness of the coherent mass is such that the cross-sectional surface area of the mass is less than the corresponding cross-sectional area of the passage. In such a smoking article, it is desirable to prepare at least one plug for insertion in passage blocking position in the smoking article. The plug may be positioned at the end or ends of the smoking article and/or may be disposed at intermediate positions in the passage. Plugs serve both to aid ignition and as baffles to prevent flash heating through the tube due to suction on ignition or in the event of relighting. Additionally, one or more of the plugs may contain flavorant materials. Plug material must be air permeable and readily ignitable. Plugs preferably consist of comminuted tobacco material prepared in a similar manner to the coherent mass.

Flavorant additions may be made during the mixing step described hereinabove for either the tobacco-containing material, the plug material or both. Typical tobacco flavorants may be incorporated at any stage of processing, but it is generally convenient to do so during mixing. Tobacco extracts may also be incorporated at this point as part of the liquid ingredient. Extracts of Burley tobacco prepared according to methods described in U.S. Pat. Nos. 4,131,117 and 4,131,118 may be used. Other tobacco extracts or slurries prepared by processes which release the pectinaceous material contained therein may, in some instances, be employed as part of the liquid ingredients in the production of the smoking articles. Descriptions of processes for releasing the natural tobacco pectins may be found in U.S. Pat. No. 3,353,541 or 3,420,421 to Hind.

DESCRIPTION OF THE PREFERRED EMBODIMENTS

The smoking article of the present invention can be made in various forms particularly those which are conveniently extruded, although other article shaping methods can be employed to that end. With reference now to FIG. 1, the smoking article 10 comprises an elongated coherent mass 9 shaped in this embodiment as a tubular rod having a through passage 2 extending end to end thereof. While the tubular mass 9 serves in and of itself as a smoking article, it is possible to fit a filter 3 at the smoking end and join same to the mass with tipping paper 4 in conventional manner. As seen in FIG. 1, the passage 2 and the mass 9 have circular configuration but it will be appreciated that other sectional geometrics could be employed, for example, hexagonal, etc. The mass 9 may correspond generally in length and circumference to that of conventional sized cigarette tobacco cylinders. Depending upon the particular delivery characteristics to be produced with the article upon smoking of same, the cross-sectional area of the mass relative to the passage will be varied.

Figure 2:
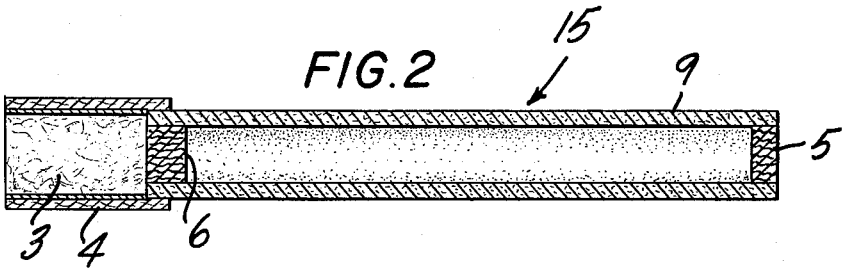
FIG. 2 shows in section a smoking article similar to FIG. 1 having a plug of smoking material positioned at both the mouth end and the ignition end of said article.

The smoking article 15 shown in FIG. 2, is fitted at the ignition end with a passage blocking plug 5 of air permeable combustible material. In addition to functioning as an ignition device, the plug 5 functions to prevent flash heating through the passage when lighting the smoking article. Additional plugs, for example, the plug 6 shown adjacent the filter component 3 can be provided and may serve to embody flavorant materials in the smoking article. If desired, plugs could also be disposed at one or more locations intermediate the ends of the smoking article to serve as both flavorant carriers and ignition means.

Figure 3:
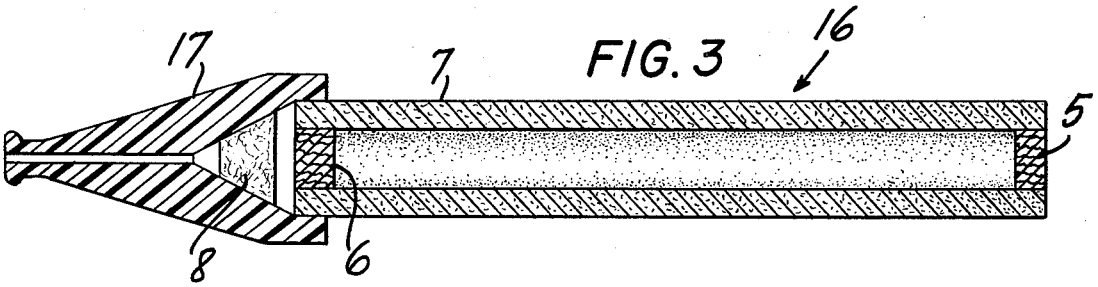
FIG. 3 is a sectional view of a cigar-like smoking article having thickened walls, and fitted with a mouthpiece.

In accordance with the present invention, the smoking article can be provided in the familiar shapes of other types of smoking articles, as for example, in the fashion and approximate dimensions of a cigar 16 as shown in FIG. 3. In such article 16, the walls 7 of the tubular mass will be of greater thickness relative to the size of the article and as compared with the FIG. 2 smoking article. In addition to ignition and flavorant plugs 5 and 6, the article can be fitted with a mouthpiece 17, which in turn itself can serve to embody flavor releasing elements or filter means 8.

Figure 4:
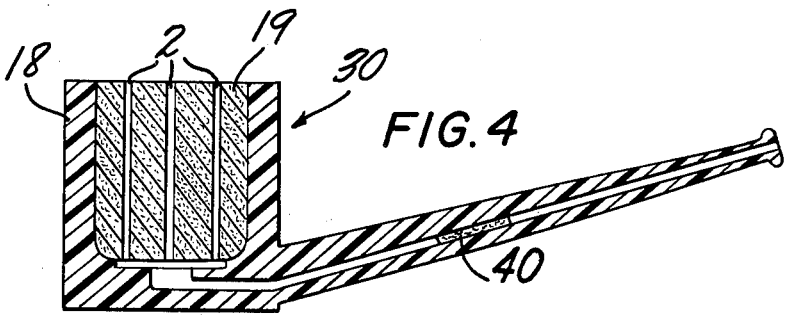
FIG. 4 is a sectional view through a smoking article comprising a preformed body of smoking material having multiple channels therethrough disposed in the bowl of a pipe.
Figure 5:
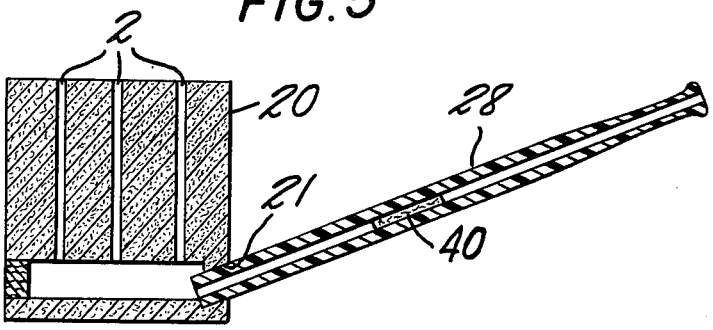
FIG. 5 shows a smoking article similar to FIG. 4, in which the entire pipe bowl is preformed from combustible material.

FIGS. 4 and 5 illustrate the manner of providing a smoking article either for utilization in a conventional smoking pipe or as a pipe shaped component as such. The smoking article 30 shown in FIG. 4 is formed as a relatively truncated mass 19 shaped and sized for reception in the bowl of pipe 18, with the mass being provided with one or more through passages 2 extending from top to bottom thereof. FIG. 5 shows the manner in which a coherent mass 20 is shaped in the form of a smoking pipe bowl and like the FIG. 4 mass has one or more passages 2 and is fitted with a side opening as at 21 for reception of a pipe stem 28 having a filter 400 as does pipe 18.

EXAMPLES

Density of the rods formed in the hereinbelow examples was determined according to the following formula:

$$\left[\pi \times \left[\left(\frac{OD}{2}\right)^2 - \left(\frac{ID}{2}\right)^2\right] \times \frac{\text{rod length}}{\text{rod weight}}\right]^{-1}.$$

wherein OD is the outer diameter of the rod in centimeters, ID is the inner diameter of the rod in centimeters and the length and weight of the rod are in centimeters and grams respectively.

Pressure drop (ΔP) was measured by blocking an open extruded tube at one end while inserting the other end in a pressure drop instrument (P.D.I.). The ΔP recorded is inversely proportional to the air flow through the walls of the tube.

The following examples are illustrative of the invention.

EXAMPLE 1

Bright tobacco having an approximate moisture content of 11.06% OV was ground in a Fritsch-Pulverisette. The ground tobacco was passed through a 60-mesh screen to remove coarse particles and the fraction having a sieve size of 60 or smaller (−60 mesh) was selected for further processing.

To 224.9 g of the −60 mesh tobacco which had a moisture content of 11.06% OV, was added 48.0 ml of 95% ethanol and 47.1 g water. This mixture was stirred in a Hobart mixer (Model N-50) equipped with a conventional "B"-flat beater blade for approximately 20 minutes.

The tobacco mixture having a solids content of 64.5% by weight was then extruded to form tubes having a wall thickness of 0.5 mm. A Wayne Plastics 1" extruder with 1:1 compression ratio screw, 3 zone automatic heat, and 3 zone automatic fan cooling, straight tubing die having an 8 mm outer diameter (OD) and 7 mm inner diameter (ID) and 3 HP variable speed (0 to 60 rpm) drive (SCR) was employed to effect extrusion. Zones 1 through 3 were maintained at room temperature. The maximum die head pressure was 1500 psig. Although these extrusion conditions were favorable for small runs, for large, continuous runs it was necessary to cool the barrel to prevent skin formation on the rod.

Some of the extruded tobacco tubes were dried in an Appollo Microwave oven for 5 minutes and maximum power. After drying, the tubes were ignited and maintained a static burn.

Extruded tubes were also allowed to dry at room temperature overnight. These tubes were then cut into 85 mm lengths having an average measured weight of 12.70 mg/mm and a calculated density of 1.078 g/cc. Four of these tubes were allowed to static burn, and the average burn time was determined and found to be 4.8 mm/minute. Other room temperature dried tubes were smoked automatically under controlled laboratory conditions. TPM and tar delivery were measured using standard analytical techniques of the tobacco industry. The average TPM/Puff was 0.35 mg and the average tar/Puff was 0.28 mg.

EXAMPLE 2

677.7 g of bright tobacco (−60 mesh) having a moisture content of 11.56% OV was combined with 144 ml 95% ethanol and 138 g water. The mixture was stirred in a Hobart mixer for 30 minutes, covered and left at ambient temperature for 1.5 hours. The percent solids prior to extrusion was 65.82%.

The equipment and conditions for extrusion were identical to those of Example 1. The die pressure during the collection of samples was approximately 500 psig, and the maximum melt temperature of the extrudate at the die head was 110° F. The extruded tubes had an outer diameter of 8 mm and an inner diameter of 7 mm and a wall thickness of 0.5 mm.

The tubes were allowed to dry overnight at room temperature. Representative samples were cut to 85 mm lengths, having an average weight of 12.64 mg/mm. The calculated density was 1.073 g/cc. The static burn was determined as in Example 1 and found to be 3.52 mm/min. TPM and tar delivery/puff, also determined as in Example 1, were found to be 0.26 mg and 0.16 mg respectively.

In addition, the smoke from the third puff of four tobacco tubes was collected and their gas phase constituents measured using conventional gas chromatography techniques. The average gas concentrations of the third puff of the four samples was as follows:

$O_2$-9.61 mg/tube third puff
CO-0.07 mg/tube third puff
$CO_2$-1.11 mg/tube third puff Finally, average pressure drop of 5 representative 85 mm tubes was found to be 1.56 inches of $H_2O$.

EXAMPLE 3

564.7 g bright tobacco (−60 mesh) having a moisture content of 11.5 OV was combined with 120 ml of 95% ethanol and 115.3 g water in a manner identical to that used in Example 2. The mixture was stirred for 25 minutes and thereafter was allowed to stand covered overnight. Prior to extrusion, the mixture had a solids content of 65.05%.

The die of the extruder was modified to extrude a tobacco tube having an outer diameter of 8 mm and an inner diameter of 5 mm. Employing the equipment of Example 1, the extrusion conditions were as follows:

| | Extrusion Conditions | |
|---|---|---|
| Time | PSIG Head Pressure | Melt T° F. |
| 0 minutes | 0 | 75 |
| 5 minutes | 550 | 85 |
| 10 minutes | 450 | 98 |
| 15 minutes | 375 | 105 |
| 20 minutes | 375 | 106 |
| 25 minutes | 375 | 109 |
| 30 minutes | 375 | 110 |
| 34 minutes | 350 | 112 |

The extruded tubes were dried overnight at room temperature. Representative examples of tubes extruded between the time interval of 6 to 10 minutes were coded A and additional tubes extruded between approximately 23 and 28 minutes were coded B. Representative tobacco tubes were analyzed and the results are tabulated in Table 1 below.

TABLE 1

| Example Units | Rod Weight mg/mm | Density g/cc | Blank off ΔP for 85 mm Inches of $H_2O$ | Static Burn Rate mm/minute | TPM Puff mg | Tar Puff mg | Third Puff CO mg | Wall Thickness mm |
|---|---|---|---|---|---|---|---|---|
| 3A | 31.69 | 1.035 | 0.60 | 1.91 | 0.36 | 0.28 | 0.16 | 1.5 |
| 3B | 32.51 | 1.061 | 4.65 | 1.21 | 0.22 | 0.18 | 0.09 | 1.5 |

EXAMPLE 4

443.21 g Burley tobacco (−60 mesh) having a moisture content of 9.75% OV was stirred in a Hobart mixer with 96 ml of 95% ethanol and 100.8 g water for approximately 25 minutes. The mixture had a solids content of 64.5% prior to extrusion.

Burley tobacco tubes having an outer diameter of 8 mm and an inner diameter of 6.5 mm were extruded using the Wayne plastics extruder previously described and under conditions identical to Example 2 with the exception that the gearing on the extruder was changed to increase the range of rotation of the screw from 0–120 rpm. During extrusion the maximum head pressure was 2500 psig and the maximum melt temperature was 151° F.

EXAMPLE 5

440.8 g of Oriental tobacco (−60 mesh) having a moisture content of 9.25% OV was combined with 96 ml 95% ethanol and 103.2 g water. The mixture was stirred for 25 minutes and extruded using the same die as in Example 4. Extrusion conditions and equipment were identical to Example 4. The maximum head pressure was 600–700 psig and maximum melt temperature was 110° F. The tobacco tubes exiting the extruder die were found to be slightly sticky and were more flexible than either bright or burley tobaccos.

EXAMPLE 6

A blended tobacco tube was prepared using the following ingredients: 220.1 g bright tobacco at 9.12% OV, 110.8 g burley tobacco at 9.75% OV, 110.8 g Oriental tobacco at 9.25% OV, 96.0 ml 95% ethanol and 102.0 g water. All starting tobacco materials were −60 mesh.

The dry tobacco materials were blended in the Hobart mixer and the alcohol and water were added. After 25 minutes of mixing, the material was extruded as previously described in Example 4. The maximum head pressure was 950 psig and the maximum melt temperature was 112° F.

The blended extruded tobacco tubes exiting the die appeared to be more flexible than a tube of all bright tobacco tube but less flexible than a tube of all burley or all Oriental tobacco.

EXAMPLE 7

An all bright tobacco tube was extruded using the same procedure and die as in Example 4. The ingredients employed were 440.1 g bright tobacco (−60 mesh) at 9.12% OV, 96.0 ml 95% ethanol and 103.9 g water.

During extrusion, the maximum head pressure reached 1400 psig and the maximum melt temperature was 116° F.

EXAMPLE 8

The following tobacco constituents were blended in a Hobart mixer:

220.1 g bright tobacco (−60 mesh) at 9.12% OV
110.8 g burley tobacco (−60 mesh) at 9.75% OV
110.2 g Oriental tobacco (−60 mesh) at 9.25% OV To the tobacco mixture was added in an alternating manner 102.9 g water and 26.0 ml of a cigarette flavorant solution in 70 ml of ethanol. The flavorant solution typically contains humectants and flavorants routinely used in tobacco processing. After all the solutions were added, the total mixture was stirred for an additional 25 minutes.

The tobacco mixture having a total solids content of 64.5% was then extruded using the Wayne Plastics 1" extruder. Zones 1 through 3 were maintained at room temperature during extrusion. The maximum head pressure was 950 psig and the maximum melt temperature was 127° F. The extruded tubes, having an outer diameter of 8 mm and an inner diameter of 6.5 mm, appeared to be very pliable as they exited the die.

EXAMPLE 9

In a manner similar to Example 8, the following ingredients were combined and mixed in a Hobart mixer:

220.1 g bright tobacco (−60 mesh) at 9.12% OV
110.8 g burley tobacco (−60 mesh) at 9.75% OV
110.2 g Oriental tobacco (−60 mesh) at 9.25% OV
10.0 g mixed sugar solution
96.0 ml 95% ethanol
92.9 g water The water and ethanol were mixed and added to the tobacco materials in an alternating manner with the sugar solution. Mixing continued for 25 minutes after all ingredients were added. The percent solids was 64.5%.

Tobacco tubes were extruded in a manner identical to that of Example 8. During extrusion, the maximum head pressure was 900 psig and the maximum melt temperature was 126° F.

The extruded tubes were dried in an oven at 100° C. overnight. Sample tubes lighted immediately after removal from the oven would maintain a static burn. Tubes which had been dried in the oven and then equilibrated at room temperature would also static burn, although some tended to go out and required relighting.

EXAMPLE 10

The following ingredients were combined and mixed in a Hobart mixer:

286.1 g bright tobacco (−60 mesh) at 9.12% OV
110.8 g burley tobacco (−60 mesh) at 9.75% OV
44.1 g Oriental tobacco (−60 mesh) at 9.25% OV
10.0 g mixed sugar solution
13.0 ml flavorant solution (humectant and flavorants)
92.2 ml 95% ethanol
106.4 g water The materials were blended approximately 25 minutes following addition of all ingredients. The percent solids was 64.5%. Extrusion of tobacco tubes having an 8 mm outer diameter and 6.5 mm inner diameter was conducted under identical conditions described in Example 8. The maximum head pressure noted was 700 psig and the maximum melt temperature was 126° F.

Selected representative tubes were dried overnight in an oven at 100° C. The dried tubes successfully burned. Tubes that had been dried and equilibrated at ambient room temperature would also static burn. It was noted on burning that a distinctive cigar aroma was produced by the tobacco tube.

EXAMPLE 1

Representative extruded tubes from Examples 4 through 7 were dried in an oven at 100° C. overnight. One-half of the tubes were lit immediately after removal from the oven to determine whether a static burn could be maintained. The remaining half were equilibrated at room temperature overnight and then tested for static burn. The results are set forth in Table 2.

TABLE 2

| Example | Dried | Dried and Equilibrated |
|---|---|---|
| 4 | Burned | Burned |
| 5 | No Static Burn | No Static Burn |
| 6 | Burned | Burned |
| 7 | Burned | Burned |

EXAMPLE 12

The tobacco tubes prepared in Examples 5 and 8 would not maintain a satisfactory static burn. However, when the extruded tubes were subjected to the water treatment described below, it was found that substantially improved combustion properties were obtained.

Extruded tubes were cut to a length of 100 mm and were then submerged in water so that a length of 50 mm per tube became wet. The tubes were dried in a microwave oven and conventional cellulose acetate filters were attached to each tube. The static burn rate and length of tube which burned were determined. The results are tabulated below in Table 3.

TABLE 3

| Sample | Time Submerged Seconds | Static Burn Rate | Length Burned |
|---|---|---|---|
| Example 5 | 30 | no burn | — |
| Example 5 | 45 | no burn | — |
| Example 5 | 60 | 0.75 | 10 mm |
| Example 5 | 90 | 1.81 | 50 mm |
| Example 8 | 30 | 2.58 | 50 mm |

EXAMPLE 13

433.1 g of bright tobacco (−60 mesh) having 7.46% OV was combined with 96 g of 95% methanol and 110.9 g water. The material was mixed in a Hobart mixer for 25 minutes at room temperature.

The tobacco mixture, having approximately 62.5% solids, was extruded using a Wayne plastic extruder equipped with an 8 mm outer diameter and 7 mm inner diameter tubing die. Extrusion conditions were identical to those employed in Example 4. The pressure in the extruder increased to 1,200 psi as the first tubes were collected and when the extrusion was terminated 17 minutes later the pressure was recorded at 1,000 psi.

The hollow, extruded tubes were dried overnight at room temperature. The outer walls of the tubes appeared to be very smooth and dense. Attempts to static burn the tubes were unsuccessful.

Extruded tubes, 100 mm in length, prepared as above were immersed in water to a depth of 50 mm for varying periods of time. The tubes were thereupon dried in a microwave oven for two minutes. The pressure drop of each tube was determined prior to and after water treatment. The results are shown in Table 4.

TABLE 4

| Time Submerged Seconds | Pressure Drop - Inches of $H_2O$ Before | After |
|---|---|---|
| 5 | 60.99 | 60.54 |
| 10 | 60.50 | 57.71 |
| 15 | 60.62 | 52.07 |
| 20 | 60.57 | 16.48 |
| 25 | 60.71 | 10.21 |
| 30 | 60.05 | 5.70 |

The results indicate that water treatment significantly modifies the tube wall thereby decreasing the pressure drop.

EXAMPLES 14

In a manner similar to Example 13, the following materials were combined and mixed in the Hobart mixer to form a mixture having 62.5% solids which was extruded using the Wayne plastics extruder:

324.8 g bright tobacco (−60 mesh) at 7.65% OV
72.0 g 95% n-propyl alcohol
83.2 g water The initial material that exited the extruder appeared to be quite dry. Extrusion continued for approximately 15 minutes; production of tubing was slower than normally observed. The extruded hollow tubes were dried overnight at room temperature. The tubes, when ignited, would static burn.

EXAMPLE 15

In a manner similar to Example 13, the following ingredients were combined and mixed to form a mixture having 62.5% solids which was extruded using the Wayne Plastics extruder:

324.8 g bright tobacco (−60 mesh) at 7.64% OV
72.0 g 95% isopropyl alcohol
83.0 g water The pressure in the extruder rose to 1,300 psi during extrusion. The extruded hollow tubes had good mechanical properties. After drying overnight at room temperature, the tubes were tested for static burn. The tubes would not maintain static burn under normal testing conditions.

EXAMPLE 16

In a manner similar to Example 13, the following materials were combined and mixed for 25 minutes to form a mixture having 62.5% solids which was extruded under identical conditions described previously:

324.8 g bright tobacco (−60 mesh) at 7.64% OV
72.0 g 95% isobutyl alcohol
83.2 g water The mixture was fed to the extruder hopper and the extruder was started. Liquid began to appear at the die opening; however, the tobacco material would not extrude. Apparently isobutyl alcohol was not compatible with the tobacco mixture at the above-noted proportion. The tobacco remaining in the die was dry and it appeared that the solvent and water had been squeezed from the tobacco.

EXAMPLE 17

In a manner similar to Example 13, the following materials were combined, mixed 25 minutes and then extruded:

324.8 g bright tobacco (−60 mesh) at 7.64% OV
72.0 g 95% tert-butyl alcohol
83.2 g water During extrusion the pressure varied between 1,100 psig and 1475 psig. The hollow tubes extruded appeared to have poor mechanical properties when wet. The solvent tended to evaporate rapidly on exiting the die and the tubes turned lighter in color as the solvent evaporated. After drying overnight, the extruded tubes were tested for static burn. After burning for approximately 2 minutes, the tube went out.

EXAMPLE 18

Using the procedure of Example 13, the following materials were combined and mixed to form a 62.5% solid mixture which was extruded:

324.8 g bright tobacco (−60 mesh) at 7.64% OV
72.0 g 95% methylene chloride
83.2 g water During extrusion the pressure rose to about 1,500 psi. The mechanical properties of the extruded hollow tubes were excellent. The tubes exhibited a high degree of plasticity and could be stretched without rupturing. Lengths greater than one meter could be extruded successfully. The dried tubes would not maintain static burn.

EXAMPLE 19

Using the procedure of Example 13, the following materials were combined and mixed to form a mixture having 62.5% solids which was extruded:

332.2 g bright tobacco (−60 mesh) at 9.7% OV
34.2 g methylene chloride
36.0 g ethanol
77.0 g water On extrusion, the tubes exhibited some plasticity; however, it was not as great as observed when methylene chloride was used as the major solvent.

EXAMPLE 20

Representative tubes prepared in Examples 13, 15, 17, 18 and 19 were cut to a length of 100 mm. The tubes were immersed in water for 30 seconds in such a manner that exactly 50 mm of each tube came in contact with the water. The tubes were dried for 2 minutes in CEM Corp. Model AVC-MP microwave oven at maximum power. Conventional cellulose acetate filters were attached to the untreated end of each tube after drying. The tubes were secured by the filter end and the water treated end was ignited. The static burn rate was based on the time required to burn the 50 mm water treated portion of the tube. The results are tabulated below in Table 5.

TABLE 5

| Solvent and Tobacco | Static burn Rate mm/min |
|---|---|
| Methyl Alcohol | 1.85 |
| Isopropyl Alcohol | 3.64 |
| Tert-Butyl Alcohol | 2.13 |
| Methylene Chloride | 0.68[1] |

TABLE 5-continued

| Solvent and Tobacco | Static burn Rate mm/min |
|---|---|
| Methylene Chloride-Ethanol 1:1 | 2.42 |

[1]The tube immersed for 30 seconds would not static burn. After immersion for 45 seconds, the tube burned for 8 minutes 5 seconds and went out. After relighting the tube burned for an additional 6 minutes 35 seconds. Total length burned was 10 mm.

The results indicate that when dried extruded tobacco tubes are subjected to a water treatment, the tube wall is modified in such a manner that combustion properties of the tube are improved.

EXAMPLE 21

The following ingredients were combined and mixed in a Hobart mixer for approximately 25 minutes:

154.05 g bright tobacco (−60 mesh) at 9.15% OV
61.53 g PCB* carbon (−40 +60 mesh) at 2.48% OV
48.0 ml 95% ethanol
56.4 g water

*PCB=Pittsburgh Coal Carbon −40 +60 mesh

The tobacco-carbon mixture having 64.5% solids was dark but appeared to have the same consistency as previous mixtures used.

Using extrusion conditions from Example 8, tobacco-carbon tubes were produced wherein the outer diameter was 8 mm and the inner diameter was 6.5 mm. During extrusion the maximum head pressure was 2000 psig and the maximum melt temperature was 106° F.

After drying overnight, the tobacco-carbon tubes would maintain a static burn.

EXAMPLE 22

Tobacco-carbon tubes wherein carbon represented approximately 40% of the total solids in the formulation were prepared using the following ingredients:

206.7 g bright tobacco (−60 mesh) at 9.12% OV
130.3 g PCB carbon (−60 +140 mesh)
75.1 ml 95% ethanol
88.7 g water (64.5% solids)

Tobacco-carbon tubes were extruded wherein the outer diameter was 8 mm and the inner diameter was 5 mm. The Wayne plastics extruder was modified to include a low restriction spider to improve flow properties.

The extruder conditions were as follows:

Zone 1-100° F.
Zone 2-150° F.
Zone 3-200° F.
Die-250° F.
Screw Speed 120 rpm

During extrusion the head pressure built up to about 600 psig and this was followed by rapid extrusion of tube product. As the pressure dropped, tube production ceased; however, with pressure build up, product was again extruded.

Samples of extruded tubes were dried overnight and tested for static burn. All samples maintained a static burn.

EXAMPLE 23

The following ingredients were combined and mixed in a Hobart mixer:

154.0 g bright tobacco (−60 mesh) at 9.12% OV
60.0 g calcium carbonate at 0.06% OV (−50 mesh)
48.0 ml 95% ethanol
57.9 g water (64.5% solids)

After mixing for 25 minutes, tobacco tubes were extruded using the conditions described in Example 8. The maximum head pressure reached 1000 psig during extrusion. The extruded tubes appeared to have a diameter slightly larger than 8 mm. This may be due to minimal expansion caused by the carbonate salt.

EXAMPLE 24

Bright tobacco, 222.3 g, −60 mesh at 10.09% OV, was combined with 84.8 g of water and mixed in a Hobart mixer for 1 hour and 20 minutes. Fifty g of ammonium carbonate at 20% OV was added and the mixture was stirred for 10 minutes.

The material was extruded using the Wayne plastic extruder under the following conditions: Zone 1-30° C.; Zone 2-50° C.; Zone 3-70° C.; Die 100° C.; Feed Cooling Water on; Straight Tubing Die (8 mm outer diameter, 7 mm inner diameter).

No die head pressure was observed: The die temperature was reduced to 90° C. during extrusion.

A representative example of the extruded tubes, cut to a 85 mm length, was equilibrated overnight to 60° RH in a humidity cabinet. On ignition with a gas flame, the hollow tube maintained a static burn for over 6 minutes. A 20 mm section of the tube had a burn rate of 0.185 mm/second.

EXAMPLE 25

200.2 g bright tobacco (−40 +60 mesh) at 10.0% OV and 150.0 g tobacco slurry containing diammonium phosphate at 18.0% solids prepared according to U.S. Pat. No. 3,353,541 were blended in a Hobart mixer for 2 hours to give a mixture having approximately 59.12% solids.

The material, which tended to form small balls, was successfully extruded using the Wayne Plastics extruder. All three zones and the die were initially at room temperature and no cooling was used during extrusion. Screw speed was between 30 to 60 rpm; head pressure was 700 psig.

Extrusion was stopped and the die temperature was raised to 100° C. Additional tubes having 8 mm outer diameter and 7 mm inner diameter were successfully extruded.

Upon ignition with a gas flame, a sample tube static burned for approximately 3 minutes, 20 seconds.

EXAMPLE 26

222.3 g of bright tobacco (−60 mesh) having a moisture content of 10.05% was combined with 177.7 g water. The mixture was stirred in a Hobart mixer for 1.5 hours.

The tobacco mixture having a solids content of 50% by weight was then fed into the extruder hopper and an attempt was made to extrude 8 mm O.D.×7 mm I.D. hollow tobacco tubes.

The extruder temperature controllers were set as follows:

Zone 1 50° C.
Zone 2 70° C.
Zone 3 90° C.
Die 200° C.
Hopper cooling water on

The extruder used in this experiment was a Wayne Machine & Die Co. yellow jacket table top extruder with a one inch barrel. The extruder was supplied with four automatic temperature controls, three zones on the barrel and one on the die, water cooled hopper feed, cooling fans mounted on barrel, a 1:1 extrusion screw, and a 0–10,000 psi Gentron No. GT-90 pressure gauge.

The tobacco mixture would not extrude using the above temperature conditions.

The temperature was reduced to 110° C. and a small amount of tobacco was extruded, but not in tube form. Upon cleaning the extruder, it was noted that the tobacco mixture had plugged the die.

EXAMPLE 27

222.3 g of bright tobacco (−40 mesh) having a moisture content of 10.05% was combined with 111.0 g water. The mixture was stirred in a Hobart mixer for 1.5 hours.

The tobacco mixture having a solids content of 50% by weight was then fed into the hopper of the extruder described in Example 1 and an attempt was made to extrude 8 mm O.D.×7 mm I.D. hollow tobacco tubes.

The initial temperatures controller settings were as follows:

Zone 1 30° C.
Zone 2 50° C.
Zone 3 70° C.
Die 100° C.
Hopper cooling water on

Tobacco tubes were extruded under these conditions. Steam was noted to exit the die during extrusion. The temperature of Zone 3 was then raised to 100° C. Tobacco tubes were extruded under these conditions and more steam was noted to exit the die than at the 70° C. setting.

The temperature of the die was then raised to 140° C. Tobacco tubes were extruded under these conditions. Steam was noted to exit the die and the exterior surface of the extruded tubes was more irregular (not smooth) than under previous conditions. None of the samples extruded under the above extrusion conditions would maintain static burning.

EXAMPLE 28

224.9 g of bright tobacco (−20 +40 mesh) having a moisture content of 11.06% was combined with 17.5 g water. The mixture was stirred in a Hobart mixer for 2 hours.

The tobacco mixture having a solids content of 50% by weight was then fed into the extruder hopper and an attempt was made to extrude 8 mm O.D.×7 I.D. hollow tobacco tubes.

The extruder temperature controllers were set as follows:

Zone 1 ambient
Zone 2 ambient
Zone 3 ambient
Die off
Hopper cooling water off

Ambient temperature settings were obtained by positioning the controller setting to such a position that the controller was supplying neither heat nor cooling. For this experiment, ambient temperature was 21° C.

The tobacco mixture would not extrude under these conditions.

EXAMPLE 29

224.9 g of bright tobacco (−20 +40 mesh) having a moisture content of 11.06% was combined with 108.43 g water. The mixture was stirred in a Hobart mixer for 2.0 hours.

The tobacco mixture having a solids content of 60% by weight was then fed into the extruder hopper and an attempt was made to extrude 8 mm O.D.×7 mm I.D. hollow tobacco tubes. The extruder temperature controllers were set the same as in Example 28. There was no hopper cooling water.

The tobacco mixture would not extrude under these conditions. The die temperature was then raised to 100° C. A small amount of tobacco was extruded, but the tubes collapsed when placed on a paper towel.

EXAMPLE 30

112.5 g of bright tobacco (−40 +60 mesh) having a moisture content of 11.06% was combined with 61.33 g water and 17.0 g 95% ethanol. The mixture was stirred in a Hobart mixer for 1.25 hours. 112.5 g of bright tobacco (−20 +40 mesh) having a moisture content of 11.06% was then added to the mixture and stirred for an additional 0.25 hour. The tobacco mixture having a solids content of 65.9% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded, placed on paper towels and allowed to dry in room air overnight. The tubes would maintain static burn when dried.

EXAMPLE 31

224.9 g of bright tobacco (−40 +60 mesh) having a moisture content of 11.06% was combined with 39.71 g water and 33.99 g ethanol. The mixture was stirred in a Hobart mixer for 1 hour. by weight was then fed into the extruder hopper in an attempt to extrude 8 mm O.D.×7 mm I.D. hollow tobacco tubes. The extrusion conditions were exactly the same as Example 28.

Hollow tobacco tubes were extruded. When the tubes were allowed to air dry overnight, they would not maintain static burn.

EXAMPLE 32

224.9 g of bright tobacco (−40 +60 mesh) having a moisture content of 11.06% was combined with 55.1 g water and 42.08 g ethanol. The mixture was stirred in a Hobart mixer for 1 hour.

The tobacco mixture having a solids content of 62.1% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded. When the tubes were allowed to air dry overnight, they would not maintain static burn.

EXAMPLE 33

224.9 g of bright tobacco (−60 mesh) having a moisture content of 11.06% was combined with 65.3 g ethanol. The mixture was stirred in a Hobart mixer for 1 hour.

The tobacco mixture having a solids content of 68.9% by weight was then fed into the extruder hopper in an attempt to extrude 8 mm O.D.×7 mm I.D. hollow tobacco tubes. The extrusion conditions were exactly the same as Example 28. The tobacco mixture would not extrude under these conditions.

EXAMPLE 34

344.27 g of bright tobacco (−40 +60 mesh) having a moisture content of 12.9% was combined with 63.73 g water and 56.81 g ethanol. The mixture was stirred in a Hobart mixer for 25 minutes. The mixture was then sealed in the mixing container and allowed to stand for 1.25 hours.

The tobacco mixture having a solids content of 64.5% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded under these conditions but the tubes disintegrated shortly after exiting the extruder die. The tobacco particles were not bound together by the extrusion process.

EXAMPLE 35

1,092.2 g of bright tobacco (−60 mesh) having a moisture content of 8.44% was combined with 268.3 g water and 189.9 g 95% ethanol. The mixture was stirred in a Hobart mixer for 35 minutes.

The tobacco mixture having a solids content of 64.5% by weight was then divided into two parts. Approximately three-fourth's of the mixture was fed into the extruder referred to in Example 26 and one-fourth of the mixture was placed in the hopper feeder of a Wayne plastics extruder Model No. 2417. The Model No. 2417 extruder was modified to take a one inch water cooled barrel, a one inch 1:1 extrusion screw, and an automatic hopper feeder. It was mated to the extruder referred to in Example 26 via a modified Wayne Machine and Die Co. cross-head die.

The Model No. 2417 extruder was then operated in such a manner as to sequentially extrude the tobacco mixture into the open passage of coextruded hollow tobacco tubes which were being extruded by the extruder mentioned in Example 26. The sequential extrusion of the tobacco mixture into the 8 mm O.D.×7 mm I.D. tubes resulted in the plugs, approximately 5 mm in length, located at approximately 70 mm intervals along the longitudinal axis of the hollow tubes. The extrusion conditions of the hollow tubes were the same as those of Example 26 with the exception of the use of the cross-head die and coextrusion.

Some samples from this extrusion were placed in a CEM Model AUC-MP microwave oven and dried at one-half power for five minutes. The samples so dried would maintain static burn.

Additional samples of extrudate were allowed to air dry on a paper towel overnight. These samples were then cut into smokable lengths by cutting the tube samples at the midpoint of each plug resulting in samples 75 mm in length with tobacco plugs of 2.5 mm thickness, located at each end. Several small holes were then drilled longitudinally through the plugged ends of the samples using number 80 and number 69 drill bits to enable the samples to be purified on by a smoker. Cellulose acetate filters approximately 20 mm in length were then attached to one end of the samples with cellophane tape.

These samples would not maintain static burn. The samples were then dipped into water for two seconds and allowed to dry in room air overnight. After drying, the samples would maintain static burn and could be smoked.

EXAMPLE 36

327.2 g of bright tobacco (−60 mesh) having a moisture content of 8.44% was combined with 81.67 g water, 57.4 g 95% ethanol and 3.03 g tert butyl-p-menthanecarboxamide. The mixture was stirred in a Hobart mixer for 25 minutes.

The tobacco mixture having a solids content of 64.5% by weight was then divided into two parts and extruded under the same conditions as Example 35.

Plugged tube samples extruded in this manner were dried in a microwave oven the same as in Example 28. These samples would maintain static burn.

Smokable samples were produced from air dried extrudate by the same procedure used in Example 35. These samples would not maintain static burn but would burn sufficiently so that they could be lit and smoked in a normal manner. A menthol-like cooling was detected when these samples were smoked.

EXAMPLE 37

338.8 g of bright tobacco (−60 mesh) having a moisture content of 11.46% was combined with 69.2 g water and 56.8 g 95% ethanol. The mixture was stirred in a Hobart mixer for 35 minutes.

The tobacco mixture was fed into the extruder referred to in Example 26 and 8 mm O.D.×7 mm I.D. hollow tobacco tubes were extruded under the same conditions as Example 28.

Samples of the extrudate were placed on paper towels and allowed to dry in room air overnight.

Some samples collected during the time interval of 5.5 minutes to 7.0 minutes of extrusion were selected for analysis. The results of the analysis were as follows:

| | |
|---|---|
| Sample weight | 12.96 mg/mm |
| Wall density | 1.100 g/cc |
| Blank off ΔP 85 min. | 3.94 inches $H_2O$ |
| Static burn rate | 23.46 mm/min |
| TPM/Puff | .16 mg |
| Tar/Puff | .10 mg |
| Third Puff CO delivery | .03 mg |

EXAMPLE 38

451.8 g of bright tobacco having a moisture content of 11.46% was combined with 92.2 g water and 75.7 g 95% ethanol. The mixture was stirred in a Hobart mixer for 25 minutes.

The tobacco mixture having a solids content of 64.5% by weight was then fed into the extruder referred to in Example 26. The die of the extruder of Example 26 was modified to extrude 8 mm O.D.×6 mm I.D. hollow tubes. The extrusion conditions were the same as Example 28.

The extruded tobacco tubes were placed on paper towels to dry overnight in room air.

Extrudate samples collected during the time interval of 5.5 minutes to 7.5 minutes of extrusion were selected for analysis. The results of the analysis were as follows:

| | |
|---|---|
| Sample weight | 19.87 mg/mm |
| Wall density | .904 g/cc |
| Blank off ΔP 85 min. | 6.77 inches $H_2O$ |
| Static burn rate | 31.20 mm/min |
| TPM/Puff | .21 mg |
| Tar/Puff | .17 mg |
| Third Puff CO delivery | .06 mg |

What is claimed is:

1. A smoking article comprising a coherent mass of combustible tobacco-containing material, said mass having at least one through passage extending from a first opening in the surface of said mass to a second opening remote from the first, said mass having a porosity such as to support combustion of said mass when ignited, said mass being of a density and porosity such as to substantially occlude gas flow therethrough, thereby providing that puff induced air flow through the smoking article is through the passage and said mass further being of a density, porosity and cross-sectional surface area such as to produce from 0.1 mg to 0.3 mg of tar per puff.

2. A smoking article comprising a coherent mass of combustible tobacco-containing material, said mass having at least one through passage extending from a first opening in the surface of said mass to a second opening remote from the first, said mass having a porosity such as to support combustion of said mass when ignited, said mass having a density of about 1 g/cc, the density and porosity of said mass being such as to substantially occlude gas flow therethrough, thereby providing that puff induced air flow through the smoking article is through the passage.

3. The smoking article of claim 1 or 2 wherein said mass has a cylindrical shape and at least one passage extending axially therethrough.

4. A smoking article comprising a coherent cylindrical mass of combustible tobacco-containing material having a passage extending axially therethrough, said passage having a cross-sectional surface area greater than the corresponding surface area of the mass, said mass having a porosity such as to support combustion of said mass when ignited, said mass further being of a density and porosity such as to substantially occlude gas flow therethrough, thereby providing that puff induced air flow through the smoking article is through the passage.

5. A smoking article comprising a coherent mass of combustible tobacco-containing material formed by extruding a mixture comprising water and comminuted tobacco, said mass having at least one through passage extending from a first opening in the surface of said mass to a second opening remote from the first, said mass having a porosity such as to support combustion of said mass when ignited, said mass further being of a density and porosity such as to substantially occlude gas flow therethrough, thereby providing that puff induced air flow through the smoking article is through the passage.

6. A smoking article comprising a coherent mass of combustible tobacco-containing material formed by extruding a binder-free mixture comprising comminuted tobacco, water and a volatile organic liquid compatible with the tobacco, and drying the extrudate, said mixture having a solids content of from about 55 to 75 weight percent, said mass having at least one through passage extending from a first opening in the surface of said mass to a second opening remote from the first, said mass having a porosity such as to support combustion of said mass when ignited, said mass further being of a density and porosity such as to substantially occlude gas flow therethrough, thereby providing that puff induced air flow through the smoking article is through the passage.

7. The smoking article of claim 5 or 6 wherein the comminuted tobacco is less than 30 mesh.

8. The smoking article of claim 6 wherein the ratio of organic liquid to water is from about 1:6 to about 1:1.

9. The smoking article of claim 6 or 8 wherein the organic liquid is a low molecular weight alcohol compatible with tobacco.

10. The smoking article of claim 9 wherein the organic liquid is ethanol.

11. The smoking article of claim 6 wherein the comminuted tobacco is less than −60 mesh and the ratio of organic liquid to water is about 1:2.

12. The smoking article of claim 6 wherein the tobacco-containing material further comprises filler particles.

13. The smoking article of claim 12 wherein said filler particles comprise up to about 40 to 50 weight percent of the solids in the mixture.

14. A smoking article comprising a coherent mass of combustible material, said material comprising tobacco and filler particles, said mass having at least one through passage extending from a first opening in the surface of said mass to a second opening remote from the first, said mass having a porosity such as to support combustion of said mass when ignited, said mass further being of a density and porosity such as to substantially occlude gas flow therethrough, thereby providing that puff induced air flow through the smoking article is through the passage.

15. The smoking article of claim 14 wherein the filler particles are selected from the group consisting of carbon, calcium carbonate, diatomaceous earth and attapulgite.

16. A smoking article comprising a coherent mass of combustible material, said material comprising tobacco and burn additives, said mass having at least one through passage extending from a first opening in the surface of said mass to a second opening remote from the first, said mass having a porosity such as to support combustion of said mass when ignited, said mass further being of a density and porosity such as to substantially occlude gas flow therethrough, thereby providing that puff induced air flow through the smoking article is through the passage.

17. The smoking article of claim 1, 2, 4, 5, 6, 14 or 32 wherein the material is selected from the group consisting of bright tobacco, burley tobacco, oriental tobacco, reconstituted tobacco, prepyrolyzed tobacco and mixtures thereof.

18. The smoking article of claim 1, 2, 4, 5, 6, 14 or 16 which further comprises at least one air permeable plug of readily ignitable material disposed in passage blocking position.

19. The smoking article of claim 18 which further comprises a first plug disposed in passage blocking position at one end of said passage and a second plug disposed in passage blocking position remote from said first plug.

20. The smoking article of claim 19 wherein the second plug is at the other end of said passage.

21. The smoking article of claim 18, wherein at least one plug includes a thermally releasable flavorant.

22. The smoking article of claim 1, 2, 4, 5, 6, 14 or 16 wherein said mass includes a thermally releasable flavorant.

23. The smoking article of claim 1, 2, 4, 5, 6, 14 or 16 wherein said mass includes a humectant.

24. A smoking article comprising a coherent mass of combustible tobacco-containing material, said mass having at least one through passage extending from a first opening in the surface of said mass to a second opening remote from the first, said mass having a porosity such as to support combustion of said mass when ignited, said mass being of a density and porosity such as to substantially occlude as flow therethrough, thereby providing that puff induced air flow through the smoking article is through the passage, said article including at least one air permeable plug of readily ignitable material disposed in passage blocking position.

25. The smoking article of claim 24 which further comprises a first plug disposed in passage blocking position at one end of said passage and a second plug disposed in passage blocking position remote from said first plug.

26. The smoking article of claim 25 wherein the second plug is at the other end of said passage.

27. The smoking article of claim 24 wherein at least one plug includes a thermally releasable flavorant.

* * * * *

UNITED STATES PATENT AND TRADEMARK OFFICE

CERTIFICATE OF CORRECTION

PATENT NO. : 4,391,285

DATED : July 5, 1983

INVENTOR(S) : Burnett et al.

It is certified that error appears in the above—identified patent and that said Letters Patent is hereby corrected as shown below:

Column 3, line 7, "blendor" should be — blender —.
Column 4, line 26, "separtion" should be — separation —.
Column 5, line 67, "Burley" should be — burley —.
Column 6, line 7, "or" should not be in bold type.
Column 6, line 67, "400" should be — 40 —.
Column 7, after line 5 and before the formula, — Density (g/cc) = — should be inserted.
Column 7, line 41,"Plastics" should be — plastics —.
Column 7, line 53,"Appollo Microwave" should be — Apollo microwave —.
Column 7, line 53, "and" should be — at —.
Column 8, line 34, "5" should not be in bold type.
Column 8, line 66, "Representative" should begin a new paragraph.
Column 9, line 16, "Burley" should be — burley —.
Column 10, line 27,"Plastics" should be — plastics —.
Column 11, line 14, "1" should be — 11—.
Column 11, line 60,"plastic" should be — plastics —.
Column 12, line 24,"EXAMPLES" should be — EXAMPLE —.
Column 12, line 43,"Plastics" should be — plastics —.
Column 13, line 63, "burn" should be — Burn —.
Column 14, line 56, "build up" should be — build-up —.
Column 15, line 14,"plastic" should be — plastics —.

UNITED STATES PATENT AND TRADEMARK OFFICE

CERTIFICATE OF CORRECTION

PATENT NO. : 4,391,285

DATED : July 5, 1983

INVENTOR(S) : Burnett et al.

It is certified that error appears in the above—identified patent and that said Letters Patent is hereby corrected as shown below:

Column 15, line 36,"Plastics" should be — plastics —.
Column 15, line 59, "1 50° C." should be — 1-50° C. —.
Column 15, line 60, "2 70° C." should be — 2-70° C. —.
Column 15, line 61, "3 90° C." should be — 3-90° C. —.
Column 15, line 62, "Die 200° C." should be — Die-200° C. —.
Column 16, line 21, "1 30° C." should be — 1-30° C. —.
Column 16, line 22, "2 50° C." should be — 2-50° C. —
Column 16, line 23, "3 70° C." should be — 3-70° C. —.
Column 16, line 24, "Die 100° C." should be — Die-100° C. —.
Column 16, line 52,"1 ambient" should be — 1-ambient —.
Column 16, line 53,"2 ambient" should be — 2-ambient —.
Column 16, line 54, "3 ambient" should be — 3-ambient —.
Column 16, line 55, "Die off" should be — Die-off —.
Column 17, line 32,"by weight" should be — The tobacco mixture having a solids content of 67% by weight —, and this sentence should begin a new paragraph.
Column 18, line 55,"purified" should be — puffed —.
Claim 17, line 1, "32" should be — 16 —.
Claim 17, line 3,"oriental" should be — Oriental —.
Claim 21, line 1, "18," should be — 18 —.
Claim 24, line 8, "as" should be — gas —.

Signed and Sealed this

*Seventh* Day of *August 1984*

[SEAL]

*Attest:*

GERALD J. MOSSINGHOFF

*Attesting Officer* *Commissioner of Patents and Trademarks*